US009273530B2

(12) United States Patent
Vanderford et al.

(10) Patent No.: US 9,273,530 B2
(45) Date of Patent: Mar. 1, 2016

(54) ANGLED-PENETRATOR DEVICE AND SYSTEM

(71) Applicant: Cameron International Corporation, Houston, TX (US)

(72) Inventors: Delbert Edwin Vanderford, Cypress, TX (US); Kenneth Melvin Reed, Humble, TX (US)

(73) Assignee: Cameron International Corporation, Houston, TX (US)

( * ) Notice: Subject to any disclaimer, the term of this patent is extended or adjusted under 35 U.S.C. 154(b) by 95 days.

(21) Appl. No.: 13/975,279

(22) Filed: Aug. 23, 2013

(65) Prior Publication Data

US 2014/0060855 A1 Mar. 6, 2014

Related U.S. Application Data

(63) Continuation of application No. 12/863,589, filed as application No. PCT/US2009/033113 on Feb. 4, 2009, now Pat. No. 8,567,489.

(60) Provisional application No. 61/027,701, filed on Feb. 11, 2008.

(51) Int. Cl.

| | |
|---|---|
| ***E21B 33/072*** | (2006.01) |
| ***E21B 33/04*** | (2006.01) |
| ***E21B 33/03*** | (2006.01) |
| ***E21B 33/038*** | (2006.01) |

(52) U.S. Cl.

CPC ..... *E21B 33/04* (2013.01); *E21B 33/03* (2013.01); *E21B 33/0385* (2013.01); *E21B 33/0407* (2013.01)

(58) Field of Classification Search

CPC E21B 33/0704; E21B 33/072; E21B 33/0407

See application file for complete search history.

(56) References Cited

U.S. PATENT DOCUMENTS

| | | | | |
|---|---|---|---|---|
| 2,153,852 | A | 4/1939 | Tschappat | |
| 2,694,450 | A | 11/1954 | Osbun | |
| 2,696,261 | A * | 12/1954 | Ennis | 166/75.14 |
| 3,414,056 | A | 12/1968 | Brown et al. | |
| 3,638,732 | A | 2/1972 | Huntsinger et al. | |
| 4,090,565 | A | 5/1978 | McGee | |
| 4,416,495 | A * | 11/1983 | Regan | 439/192 |

(Continued)

FOREIGN PATENT DOCUMENTS

CA 2137336 A * 6/1996

OTHER PUBLICATIONS

PCT International Search Report and Written Opinion; Application No. PCT/US2009/033113; Dated Jul. 22, 2010; 14 pages.

(Continued)

*Primary Examiner* — Kenneth L Thompson
(74) *Attorney, Agent, or Firm* — Fletcher Yoder P.C.

(57) ABSTRACT

In accordance with an exemplary embodiment, a tubing hanger having an angled auxiliary bore is provided. The auxiliary bore may receive a penetrator for a cabling system that powers a submersible pump. The auxiliary bore is angled with respect to the production bore of the tubing hanger. As a result, the penetrator exits the lower end of the tubing hanger at a location relatively close to the production tubing. This facilitates the use of a smaller-diameter production casing or casing hanger, in turn helping to reduce potential costs, for instance.

24 Claims, 2 Drawing Sheets

(56) References Cited

U.S. PATENT DOCUMENTS

| | | | | |
|---|---|---|---|---|
| 4,607,691 | A | 8/1986 | Bridges | |
| 4,681,162 | A * | 7/1987 | Boyd | 166/242.5 |
| 4,716,960 | A * | 1/1988 | Eastlund et al. | 166/60 |
| 4,794,988 | A | 1/1989 | Van Bilderbeek | |
| RE34,071 | E * | 9/1992 | Van Bilderbeek | 166/342 |
| 5,213,162 | A | 5/1993 | Iato | |
| 5,722,844 | A | 3/1998 | Schraeder | |
| 5,775,420 | A | 7/1998 | Mitchell et al. | |
| 5,794,693 | A | 8/1998 | Wright et al. | |
| 5,795,169 | A | 8/1998 | Reed | |
| 6,047,776 | A * | 4/2000 | Kiang et al. | 166/379 |
| 6,202,743 | B1 | 3/2001 | Moore | |
| 6,457,530 | B1 | 10/2002 | Lam et al. | |
| 6,688,386 | B2 * | 2/2004 | Cornelssen et al. | 166/65.1 |
| 6,851,478 | B2 * | 2/2005 | Cornelssen et al. | 166/368 |
| 6,964,306 | B2 | 11/2005 | Bunney | |
| 7,445,046 | B2 * | 11/2008 | Borak, Jr. | 166/313 |
| 7,556,093 | B2 * | 7/2009 | Grigsby et al. | 166/242.6 |
| 7,604,047 | B2 * | 10/2009 | Broussard | 166/75.14 |
| 8,567,489 | B2 * | 10/2013 | Vanderford et al. | 166/75.11 |
| 8,573,294 | B2 * | 11/2013 | Struthers et al. | 166/88.4 |
| 2004/0074635 | A1 | 4/2004 | Collie et al. | |
| 2006/0137882 | A1 | 6/2006 | McGuire et al. | |
| 2009/0294131 | A1 * | 12/2009 | Lewis | 166/368 |
| 2013/0181147 | A1 * | 7/2013 | Wright et al. | 251/1.3 |

OTHER PUBLICATIONS

Singapore Written Opinion (Submitted by the Hungarian Intellectual Property Office); Application No. SG 201004633-2; Dated Feb. 28, 2012; 9 pages.

* cited by examiner

ANGLED-PENETRATOR DEVICE AND SYSTEM

CROSS-REFERENCE TO RELATED APPLICATIONS

This application claims priority to and benefit of U.S. Non-Provisional patent application Ser. No. 12/863,589, entitled "Angled-Penetrator Device and System," filed Jul. 19, 2010, which is herein incorporated by reference in its entirety, and which claims priority to and benefit of PCT Patent Application No. PCT/US2009/033113, entitled "Angled-Penetrator Device and System," filed Feb. 4, 2009, which is herein incorporated by reference in its entirety, and which claims priority to and benefit of U.S. Provisional Patent Application No. 61/027,701, entitled "Angled-Penetrator Device and System", filed on Feb. 11, 2008, which is herein incorporated by reference in its entirety.

FIELD OF THE INVENTION

The present invention relates generally to providing resources to a downhole device. More particularly, the present invention, in accordance with an exemplary embodiment, relates to a novel device and system for accommodating the penetrator of a cabling system.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, supplies of oil and natural gas have a profound effect on modern economies and civilizations. Devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for these resources, companies often spend a significant amount of time and money searching for and extracting oil, natural gas, and other subterranean resources from the earth. Particularly, once a desired resource is discovered below the surface of the earth, a fluid production system is often employed to access and extract the resource. These production systems may be located onshore or offshore depending on the location of a desired resource. Further, such systems include a wide array of components, such as valves and casing suspension devices, that control drilling or extraction operations.

In certain instances, resource extraction may be improved through the use of a device located in the production bore (i.e., a downhole device). For example, an operator may employ a submergible or submersible pump, which is an artificial-lift system that advances fluid from the subterranean reservoir to the surface. Submersible pumps generally require a motivation source, such as hydraulically-operated or electrically-operated motor, that drives the pumping mechanism. These motors are connected to a power source (e.g., hydraulic accumulators or electrical generators) located on the surface via a cabling system.

To access the downhole device, the cabling system may extend through or penetrate various wellhead components. For example, the cabling system is typically run through an auxiliary bore of a tubing hanger, and the auxiliary bore is parallel to the primary or production bore of the tubing hanger. As a result, the mouth of the production casing, which must accommodate both the production tubing and cabling system, is oversized. Indeed, when the production tubing and cabling system exit the tubing hanger parallel to one another, much of the real estate in the mouth the production casing (or casing hanger) is unused. Oversized casing strings are, of course, heavier and require more robust equipment for suspension, thus adding cost and installation time. Indeed, cost-related issues are of particular sensitivity for land-based low-pressure wells.

Various refinements of the features noted above may exist in relation to various aspects of the present invention. Further features may also be incorporated in these various aspects as well. These refinements and additional features may exist individually or in any combination. For instance, various features discussed below in relation to one or more of the illustrated embodiments may be incorporated into any of the above-described aspects of the present invention alone or in any combination. Again, the brief summary presented above is intended only to familiarize the reader with certain aspects and contexts of the present invention without limitation to the claimed subject matter.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Figure 1:
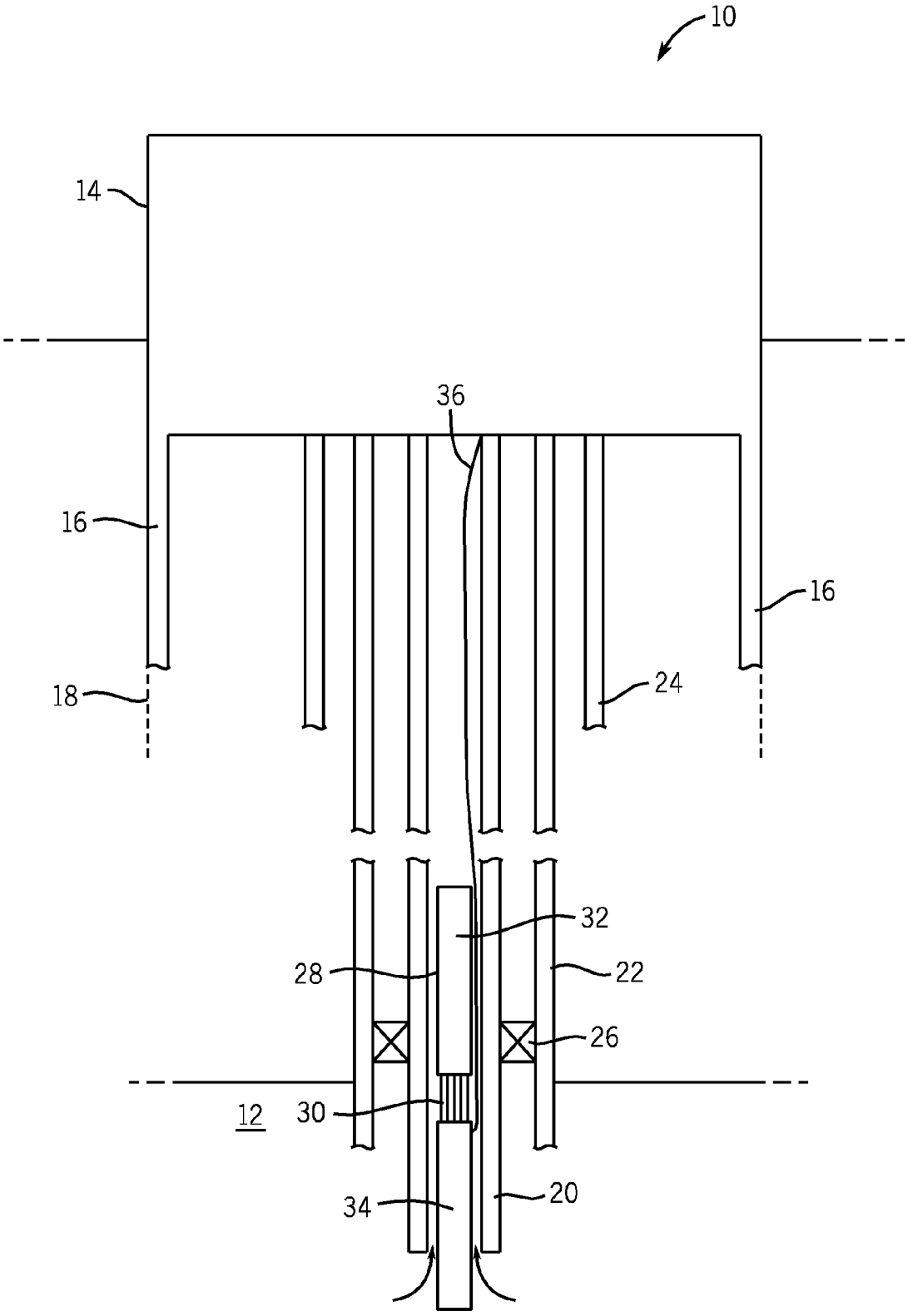
FIG. 1 is a schematic representation of a resource extraction system in accordance with one embodiment of the present invention.

Turning now to the present figures, FIG. 1 schematically illustrates a resource extraction system 10 for producing a resource, such as a hydrocarbon, from an underground reservoir 12. The system 10 includes a series of tubular members that are suspended by a wellhead assembly 14. Specifically, the outer-most tubular member is known as the conductor 16, and this conductor 16 defines the wellbore 18. The inner-most tubular member is known as the production tubing 20. This tubing 20 receives and routes the subterranean resource from the reservoir 12 to the surface. Additionally, the system may include one or more tubular members disposed between the conductor 16 and the production tubing 20. As illustrated, the present system 10 includes a production casing 22 and a surface casing 24. One or more packers 26 may be provided to isolate the annular regions between the tubular members from reservoir 12, for instance.

To aid in the extraction or production of the resource, the exemplary system 10 includes a submersible or submergible pump 28, and such pumps are fully understood by those of ordinary skill in the art. A typical submergible pump 28 includes an intake 30, a pump mechanism 32, and a motor 34 that drives the pump mechanism 32. The motor 34 may be a hydraulic motor or an electrical motor, for example. In either case, the motor 34 is coupled to a surface-located power source via a cabling system 36. (The cabling system 36 may extend downhole to power any type of electrical or hydraulic device, such as a pump or downhole safety valve, for example.)

Figure 2:
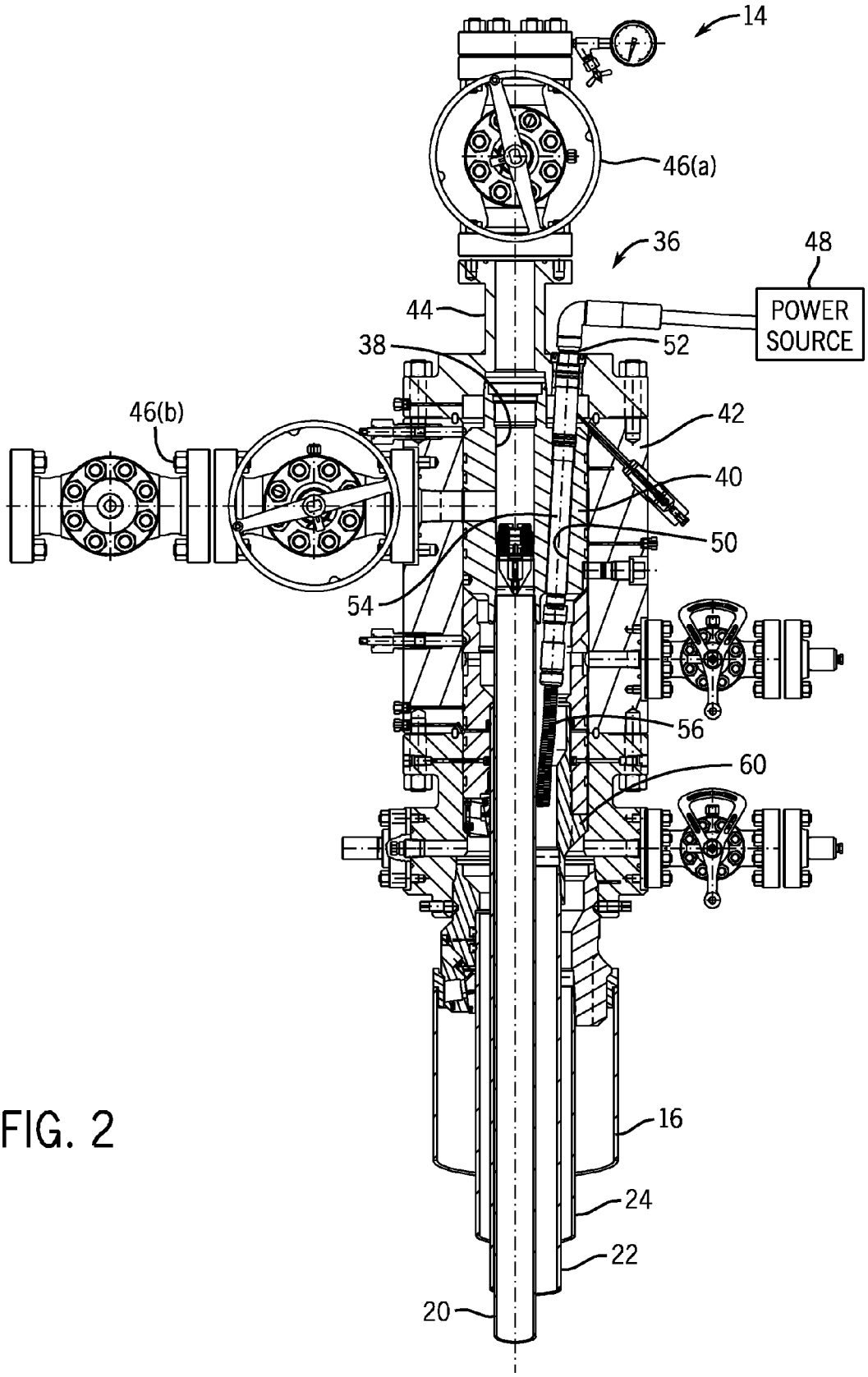
FIG. 2 is schematic and cross-sectional illustration of a wellhead assembly in accordance with one embodiment of the present invention, wherein the left portion illustrates an emergency casing suspension configuration and the right portion illustrates a standard suspension configuration.

FIG. 2 is a more detailed representation of a wellhead assembly 14 in accordance with an embodiment of the present invention. As illustrated, the wellhead assembly 14 includes annular components that cooperate with the production tubing to define a production bore 38, through which the resource is produced. Specifically, the wellhead assembly 14 includes an extended-neck tubing hanger 40 that is supported by a tubing head 42, an adapter flange 44 fastened above and to the tubing head 42, and a production tree 46 (i.e., production valve) that controls egress of the produced resource. As illustrated, production tree 46(*a*) provides for vertical production, while production tree 46(*b*) provides for horizontal production via a branch bore extending from the production bore 38.

As discussed above, the exemplary wellhead assembly 14 includes features that allow the cabling assembly 36 to couple a submersible pump 32 (FIG. 1) located downhole to a power source 48 located on the surface. For example, the illustrated tubing hanger 40 and adapter flange 44 include angled cabling or auxiliary bores 50 and 52, respectively. And each angled bore 50 and 52 is concentric or coaxial with the other and is designed to accept a penetrator 54 of the cabling system 36. As will be appreciated by those of ordinary skill in the art, the penetrator 54 protects the internal cabling of the cabling system 36. The upper portion of the penetrator 54 is coupled to an elbow, while the lower portion of the penetrator 54 is coupled to cabling disposed within semi-flexible and protective sheathing 56. This sheathing 56 extends father downhole to the submersible pump 32. Moreover, the penetrator may be sealed against the bores 50 and 52 with bushing seals, or other suitable arrangements.

By tilting or angling the bores 50 and 52, the lower end of the penetrator 54 is located radially closer to the production tubing 20 than in comparison to traditional tubing hangers, which have a cabling bore that is parallel with production tubing 20. In other words, the bores 50 and 52 are not parallel with a longitudinal axis of the production tubing 20, but rather the bores 50 and 52 have an acute angle of less than 90 degrees (i.e., not perpendicular) and greater than 0 degrees (i.e., not parallel). For example, in certain embodiments, the bores 50 and 52 may have an angle of approximately 5, 10, 15, 20, 25, 30, 35, 40, 45, 50, 55, 60, 65, 70, 75, 80, or 85 degrees relative to the longitudinal axis of the production tubing 20. In certain embodiments, the angle (not parallel) of the bores 50 and 52 may be characterized as at least less than about any of the foregoing angles, e.g., less than approximately 5, 10, 15, 20, 25, 30, 35, 40, 45, 50, 55, 60, 65, 70, 75, 80, or 85. As a result, less space is required at the mouth of the casing hanger or production casing, and a smaller-diameter production casing (or casing hanger) may be used. For example, the angled bores 50 and 52 facilitate the use of a 7⅝ inch diameter production casing 22, while a comparable tubing hanger with a straight cabling bore benefits from the use of a 9⅝ inch diameter production casing 22, for example. As will be appreciated by those of ordinary skill in the art, 7⅝ inch casing is nearly twenty pounds-per-foot lighter than 9⅝ inch casing, and it is also less expensive. Resultantly, the casing hanger 60 supporting the production casing 22 suspends less weight, can be less robust and can be less expensive, for instance.

As further illustrated in FIG. 2, the bores 50 and 52 do not extend through outer circumferential walls of the tubing hanger 40 and the adapter flange 44, respectively. Instead, the illustrated bores 50 and 52 extend through outer axial walls of the tubing hanger 40 and the adapter flange 44, respectively. Thus, the bores 50 and 52 allow entry of the penetrator 54 of the cabling system 36 in a more axial direction from the top, rather than a radial direction from the side. In other words, the bores 50 and 52 may be oriented to enable insertion of the penetrator 54 through one ore more axial walls generally transverse to an axis of the production tubing 20. However, in other embodiments, the bores 50 and/or 52 may extend through the outer circumferential walls instead of outer axial walls. In either arrangement, the bores 50 and 52 may be angled at an acute angle selected to simplify the insertion of the penetrator 54 of the cabling system 36 into the production tubing 20, the production casing 22, or other tubing.

The present technique of angling the cabling bores can be expanded and applied to any auxiliary bore that provides a surface resource to a downhole component within a wellhead system. For example, the angled cabling bore may be provided in other wellhead members or components, such as support flanges, casing hangers or heads, to name just a few.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a first wellhead component, comprising:

a first body having a first axial end, a second axial end, a first inner wall extending about a first bore along a first axis of the first body, and a first outer wall extending about the first axis of the first body; and a first cable passage extending through the first body from the first axial end to the second axial end separate from the first bore, wherein the first cable passage has a first acute angle relative to the first axis, the first cable passage extends radially inwardly with a progressively decreasing radius from a first radius to a second radius relative to the first axis, and the first cable passage is configured to receive a penetrator of a cable extending through the first cable passage and a seal disposed between the penetrator and the first cable passage.

2. The system of claim 1, wherein the first acute angle is less than 30 degrees.

3. The system of claim 1, wherein the first acute angle is less than 25 degrees.

4. The system of claim 1, wherein the first acute angle is less than 20 degrees.

5. The system of claim 1, wherein the first acute angle is less than 15 degrees.

6. The system of claim 1, wherein the first acute angle is less than 10 degrees.

7. The system of claim 1, comprising the cable, the penetrator, and the seal.

8. The system of claim 7, wherein the cable comprises an electrical cable.

9. The system of claim 7, wherein the cable comprises a hydraulic cable.

10. The system of claim 7, wherein the cable having the penetrator extends through the first cable passage, and the seal is disposed between the penetrator and the first cable passage.

11. The system of claim 7, comprising a pump coupled to the cable at a downstream end of the cable.

12. The system of claim 1, wherein the first wellhead component comprises a hanger having the first body, the first bore, and the first cable passage.

13. The system of claim 1, wherein the first wellhead component comprises an adapter flange having the first body, the first bore, and the first cable passage.

14. The system of claim 1, comprising:

a second wellhead component, comprising:

a second body having a third axial end, a fourth axial end, a second inner wall extending about a second bore along a second axis of the second body, and a second outer wall extending about the second axis of the second body; and a second cable passage extending through the second body from the third axial end to the fourth axial end separate from the second bore, wherein the second cable passage has a second acute angle relative to the second axis, and the second cable passage extends radially inwardly with a progressively decreasing radius from a third radius to a fourth radius relative to the second axis.

15. The system of claim 14, wherein the first and second cable passages are coaxial with one another, and the first and second acute angles are the same as one another.

16. The system of claim 15, wherein the first wellhead component comprises an adapter flange having the first body, the first bore, and the first cable passage, and the second wellhead component comprises a hanger having the second body, the second bore, and the second cable passage.

17. A system, comprising:

a first wellhead component, comprising:

a first body having a first axial end, a second axial end, and a first outer wall extending about a first axis of the first body; and a first cable passage extending through the first body from the first axial end to the second axial end, wherein the first cable passage is disposed on only one side of the first axis, the first cable passage has a first acute angle relative to the first axis, the first acute angle is less than 25 degrees, and the first wellhead component is configured to mount inside of a bore of another wellhead component; and a second wellhead component, comprising:

a second body having a third axial end, a fourth axial end, and a second outer wall extending about a second axis of the second body; and a second cable passage extending through the second body from the third axial end to the fourth axial end, wherein the second cable passage is disposed on only one side of the second axis, the second cable passage has a second acute angle relative to the second axis, and the second acute angle is less than 25 degrees.

18. The system of claim 17, comprising a cable extending through the first and second cable passages, and a seal disposed between the cable and the first or second cable passage.

19. The system of claim 17, wherein the first acute angle is less than 20 degrees.

20. The system of claim 17, wherein the first wellhead component comprises a first bore extending through the first body from the first axial end to the second axial end, and the first cable passage extends through the first body from the first axial end to the second axial end separate from the first bore.

21. The system of claim 17, comprising the other wellhead component having the bore, wherein the first wellhead component is disposed inside the bore of the other wellhead component.

22. A system, comprising:

a first wellhead component, comprising:

a first body having a first axial end, a second axial end, a first inner wall extending about a first bore along a first axis of the first body, and a first outer wall extending about the first axis of the first body; and a first cable passage extending through the first body from the first axial end to the second axial end separate from the first bore, wherein the first cable passage has a first acute angle relative to the first axis, and the first cable passage extends radially inwardly with a progressively decreasing radius from a first radius to a second radius relative to the first axis; and a second wellhead component, comprising:

a second body having a third axial end, a fourth axial end, a second inner wall extending about a second bore along a second axis of the second body, and a second outer wall extending about the second axis of the second body; and a second cable passage extending through the second body from the third axial end to the fourth axial end separate from the second bore, wherein the second cable passage has a second acute angle relative to the second axis, and the second cable passage extends radially inwardly with a progressively decreasing radius from a third radius to a fourth radius relative to the second axis.

23. The system of claim 22, wherein the system is configured to receive a cable through the first and second cable passages and a seal disposed between the cable and the first or second cable passage.

24. A system, comprising:

a first wellhead component, comprising:

a first body having a first axial end, a second axial end, a first inner wall extending about a first bore along a first axis of the first body, and a first outer wall extending about the first axis of the first body; and a first cable passage extending through the first body from the first axial end to the second axial end separate from the first bore, wherein the first cable passage has a first acute angle relative to the first axis, and the first cable passage extends radially inwardly with a progressively decreasing radius from a first radius to a second radius relative to the first axis;

wherein the first wellhead component comprises an adapter flange having the first body, the first bore, and the first cable passage.

* * * * *